US006840032B2

(12) United States Patent
Zenker

(10) Patent No.: US 6,840,032 B2
(45) Date of Patent: Jan. 11, 2005

(54) YARN TEXTURING MACHINE FOR PRODUCING A COMPOSITE YARN

(75) Inventor: Dieter Zenker, Köln (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/816,163

(22) Filed: Apr. 1, 2004

(65) Prior Publication Data

US 2004/0182066 A1 Sep. 23, 2004

Related U.S. Application Data

(63) Continuation of application No. PCT/EP02/11294, filed on Oct. 9, 2002.

(30) Foreign Application Priority Data

Oct. 10, 2001 (DE) ..... 101 49 921

(51) Int. Cl.[7] ..... D01H 13/02
(52) U.S. Cl. ..... 57/280; 57/279; 57/356
(58) Field of Search ..... 57/279, 280, 282–291, 57/332–349, 356

(56) References Cited

U.S. PATENT DOCUMENTS 3,559,255 A * 2/1971 Cockroft ..... 432/59
3,842,578 A * 10/1974 Schippers ..... 57/280
3,892,019 A * 7/1975 Rebsamen et al. ..... 28/220
4,332,132 A * 6/1982 Bru et al. ..... 57/280
4,550,560 A * 11/1985 Tanaka et al. ..... 57/261
4,581,883 A 4/1986 Streppel
5,008,992 A 4/1991 Gehrmann et al.
5,924,272 A 7/1999 Jaschke et al.
6,209,301 B1 * 4/2001 Baader et al. ..... 57/280

FOREIGN PATENT DOCUMENTS

| | | |
|---|---|---|
| EP | 0 364 874 A2 | 4/1990 |
| FR | 2 552 117 | 3/1985 |
| JP | 2000136450 | 5/2000 |
| WO | WO 00/22211 A1 | 4/2000 |

* cited by examiner

*Primary Examiner*—John J. Calvert
*Assistant Examiner*—Shaun R Hurley
(74) *Attorney, Agent, or Firm*—Alston & Bird LLP

(57) ABSTRACT

A yarn texturing machine for processing a plurality of synthetic yarns to form a composite yarn, and which comprises a plurality of processing units and a takeup unit. The processing units include at least two yarn feed units, which each withdraw a yarn from a feed yarn package. Also, at least one of the yarn feed units is mounted for movement on the machine frame in such a manner that it permits selecting different yarn feed positions by adjusting the yarn feed unit on the machine frame.

14 Claims, 4 Drawing Sheets

YARN TEXTURING MACHINE FOR PRODUCING A COMPOSITE YARN

CROSS REFERENCE TO RELATED APPLICATION

The present application is a continuation of international application PCT/EP02/11294, filed 9 Oct. 2002, and which designates the U.S. The disclosure of the referenced application is incorporated herein by reference.

BACKGROUND OF THE INVENTION

The present invention relates to a texturing machine for processing a plurality of synthetic filament yarns to produce a composite yarn.

It is known to use texturing machines of this type for producing a composite yarn from two false twist textured yarns. For example, U.S. Pat. No. 4,581,883 discloses a yarn false twist texturing machine wherein a feed unit withdraws each yarn from a creeled yarn package and supplies it to downstream processing units, such as, for example, a heater, a cooling device, a plurality of texturing units, and a plurality of feed units. Also, the yarns are combined and wound at the end of the process as a composite yarn. In this case, the composite yarn is formed by two crimped yarns, which receive a substantially identical treatment.

It is also possible to produce a composite yarn from two different synthetic filament yarns, as is known, for example, from EP 0 364 874 A1 and corresponding U.S. Pat. No. 5,008,992. Such composite yarns, also known as so-called novelty yarns, require a different yarn feed, since a portion of the processing units is needed only for processing one of the yarns and a portion of the processing units for processing both yarns or the composite yarn.

Irrespective of the processing of the yarns, it is common in the production of a composite yarn to withdraw the individual yarns each from a creeled yarn package by means of a feed unit. To realize the different yarn paths, for example, for advancing the yarns jointly through a heater, or for advancing one of the yarns outside of the heater, the conventional texturing machine requires additional yarn guides, which in turn produce additional yarn loopings and thus yarn frictions.

It is an object of the present invention to further develop a standard yarn processing machine of the initially described type in such a manner that it always enables a protective advance of the individual yarns irrespective of the yarn type of the composite yarn.

SUMMARY OF THE INVENTION

The above and other objects and advantages of the present invention are achieved by having at least one of the creel yarn feed units mounted for movement on the machine frame such that it permits selecting different yarn feed positions by adjusting the feed unit on the machine frame. With that, a high flexibility is achieved in the production of composite yarns. Advantageously, the yarns are able to advance from the respective creel yarn feed units directly into the downstream processing units. The selectable yarn feed positions can be predetermined as a function of the respectively required processing of the individual yarns. Thus, for example, in the production of a composite yarn from two textured yarns, it would be possible to arrange the two creel yarn feed units in one yarn advance plane. In cases, in which, for example, an elastic composite yarn is to be produced, one could arrange the two feed units in different yarn advance planes, for example, for advancing the elastic yarn outside of a texturing zone. The movability of the creel yarn feed unit is limited to instances of a product change. During the process, the creel yarn feed unit remains stationary in its respectively selected position on the machine frame.

To enable the movability of the creel yarn feed unit on the machine frame during a process change, a first advantageous further development proposes to mount the creel yarn feed unit to a support, which is held for movement on the machine frame in at least one guide rail. This advantageous development is also suited in particular for texturing machines, in which the creel yarn feed unit is formed by a continuous drive shaft, which simultaneously drives further creel yarn feed units of processing stations that are arranged parallel, one after the other. This enables a rapid adjustment of the creel yarn feed units, so that only short process interruptions are required.

The movability of the feed unit can be improved with advantage in that the guide rails are mounted to a carriage, which in turn is supported by a guideway for adjustment on the machine frame.

However, it is also possible that the support mounting the feed unit be pivotally supported on the machine frame.

In a further advantageous development of the invention, the movability of the creel yarn feed unit is realized in that a support mounting the feed unit is held on the machine frame selectively in one of a plurality of receptacles. In the respective receptacle, the support is held preferably by connection means that are releasable in a rapid and simple manner. Each of the receptacles on the machine frame thus forms a selectable yarn feed position for the creel yarn feed unit. This further development of the invention is preferably suited for feed units, which are formed by individually driven conveying rolls or godets, and which can be energized via simple plug connectors.

To increase the degree of freedom for adjusting the creel yarn feed unit, an advantageous further development of the invention provides for driving the adjustable creel yarn feed unit by a controllable individual drive. With that, the creel yarn feed unit forms a unit, which can be adjusted independently of adjacent creel yarn feed units.

To make it possible to operate the processing units within the texturing machine in a simple manner, an operator aisle is formed in accordance with an advantageous further development of the invention, between a creel module and a processing module. In this connection, the creel module preferably mounts the creel yarn feed units as well as additional processing units, which are needed over and above a standard process for producing, for example, special novelty yarns. The processing module mounts additional processing units, such as, for example texturing units and feed units. The processing units on the creel module as well as on the processing module can be accessed from the service aisle, preferably by one operator.

The further development of the texturing machine, in which the heater and cooling device are arranged above the service aisle, has the advantage that they provide an adequate length for heat treating and cooling a false twisted yarn. Furthermore, they prevent a crossing yarn path in the texturing machine.

To increase flexibility, it is further proposed that each creel yarn feed unit be formed by a godet that is looped by the yarn several times, and an associated guide roll. In this system, an individual drive operates the godet independently of adjacent feed units. In particular, the godet is also suited in an advantageous manner for changing the yarn path, so that it is possible to do without additional yarn guide elements.

BRIEF DESCRIPTION OF THE DRAWINGS

In the following, the invention is described by means of several embodiments of the texturing machine according to the invention with reference to the attached drawings, in which.

DETAILED DESCRIPTION OF THE PREFERRED EMBODIMENTS

Figure 1:
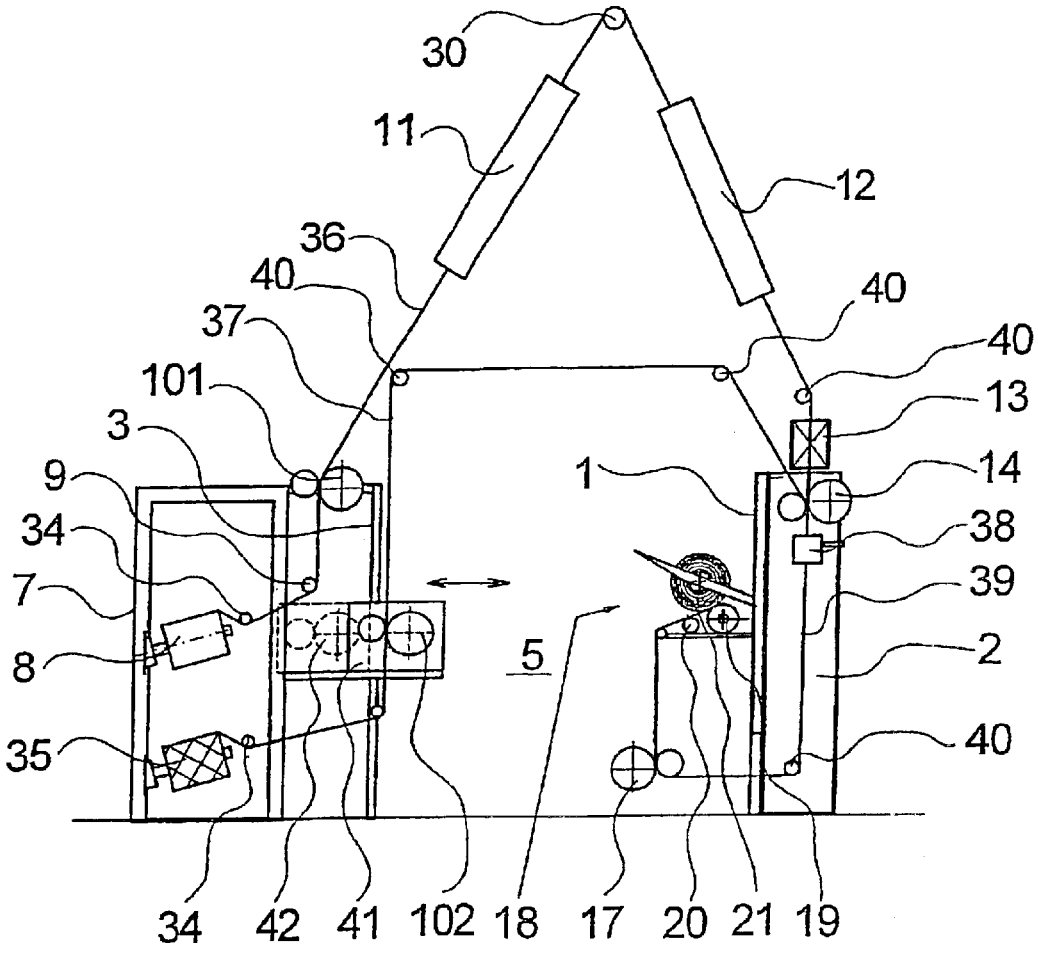
FIG. 1 is a schematic view of a processing station of a first embodiment of the texturing machine according to the invention.

FIG. 1 schematically illustrates a processing station of a first embodiment of a texturing machine according to the invention. Shown are only the most important machine frame components for accommodating a plurality of processing units. In greater detail, the Figure shows a creel module 3, a processing module 2, and a takeup module 1, with the processing module 2 and the takeup module 1 being combined in a unitary frame component. Between the takeup module 1 and the creel module 3 a service aisle 5 extends. Associated with the creel module 3 is a creel 7. Accommodated in the creel 7 are feed yarn packages 8 and 35. The feed yarn package 8 holds a yarn 36, and the feed yarn package 35 a yarn 37. Downstream of each of the feed yarn packages 8 and 35 is an overhead yarn guide 34 for withdrawing the yarns 36 and 37.

The creel module 3 mounts a first creel yarn feed unit 101. The creel yarn feed unit 101 withdraws the yarn 36 from the creel 7 via a deflection roll 9. The creel yarn feed unit 101 advances the yarn 36 to processing units 11, 12, and 13. In the present embodiment, a primary heater 11, a cooling device 12, and a texturing unit 13 form the processing units. The texturing unit 13 is arranged on the processing module 2. The primary heater 11 and the cooling device 12 are arranged in inverted V-shape on a superstructure of the texturing machine, which is not shown in the Figure. In this arrangement, the yarn 36 advances over a guide roll 30 between the primary heater 11 and the cooling device 12.

The creel module 3 mounts a further creel yarn feed unit 102, which is arranged on a support 41. The support 41 is mounted for movement along guide rails 42, which are in turn fixed to the creel module 3 and extend in a horizontal direction. With that, it is possible to position the creel yarn feed unit 102 selectively in a position moved out into the service aisle 5 (as shown in FIG. 1), or in a position on the creel module that is shifted in the direction toward the creel 7. In its retracted position, which is shown FIG. 1 in phantom lines, the creel yarn feed unit 102 forms one yarn advance plane with the creel yarn feed unit 101 thereabove. In the pulled-out position of the creel yarn feed unit 102, as shown in FIG. 1, the yarn 37 is withdrawn from the creel 7 and advanced in a plane that is offset relative the creel yarn feed unit 101. The yarn 37 is deflected over a plurality of yarn guides 40, and supplied by a draw feed unit 14 together with the previously textured yarn 36 into an entanglement device 38. In the entanglement device, the yarns 36 and 37 are combined to a composite yarn 39. A further feed unit 17 arranged on the takeup module 1 advances the composite yarn 39 to a takeup unit 18, which winds the composite yarn 39 to a package 21. The package 21 is driven by a drive roll 19. To reciprocate the composite yarn 39 along the package 21, a yarn traversing device 20 is provided.

In the case of the yarn advance and the arrangement of the creel yarn feed units 101 and 102 shown in FIG. 1, the composite yarn 39 is formed by a textured yarn 36 and an untextured yarn 37. The untextured yarn 37 could be, for example, an elastic yarn. However, it is also possible to treat the untextured yarn 37 in addition by, for example, drawing it over a draw pin.

To produce a composite yarn from two textured yarns, the creel yarn feed unit 102 can be moved by its support 41 to the position shown in phantom lines. This would cause a yarn unwinding from creel 7 to advance directly into the texturing zone.

It is preferred to operate the embodiment of the texturing machine shown in FIG. 1 semiautomatically. To this end, the packages 21 are removed by an operator.

In the present embodiment, the creel yarn feed units 101 and 102 as well as the draw unit 14 and the downstream feed unit 17 are illustrated as continuous drive shafts, each of which is contacted on its respective surface by a pressure roll. In the case of such feed units, the yarn advances between the pressure roll and the drive shaft. This accomplishes in an advantageous manner that the continuous drive shaft simultaneously services adjacent processing stations in the texturing machine. Thus, the adjustment of the creel yarn feed unit 102 occurs for all processing stations in the texturing machine at the same time.

Figure 2:
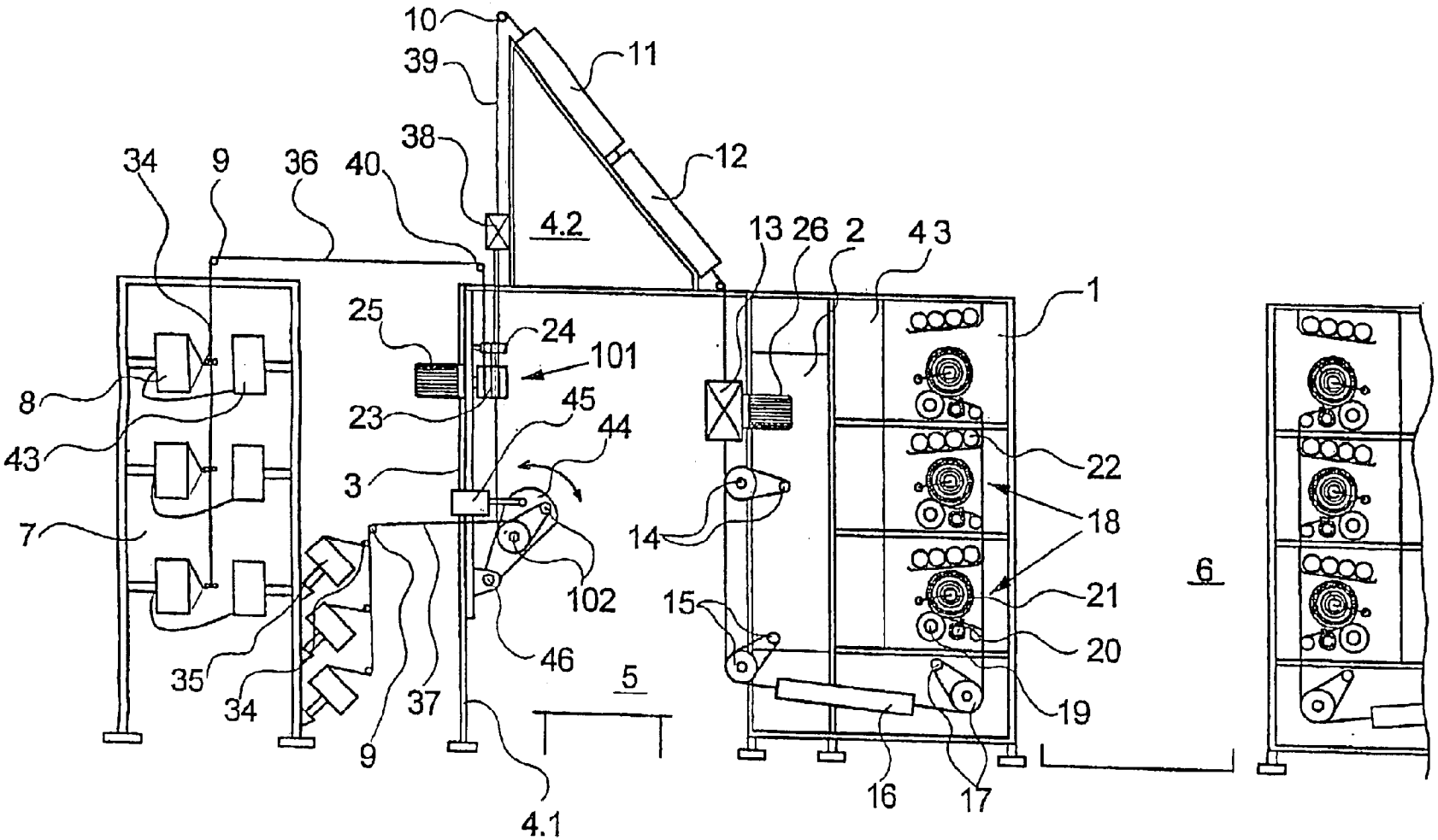
FIG. 2 is a schematic cross sectional view of another embodiment of the texturing machine according to the invention.

FIG. 2 schematically illustrates a further embodiment of the texturing machine according to the invention. The texturing machine comprises a creel module 3, a processing module 2, and a takeup module 1, which are arranged to form a machine frame with components 4.1, 4.2, and 4.3. The creel module 3 is supported by frame component 4.1, and the processing module 2 and takeup module 1 by frame component 4.3. The frame component 4.1 and the frame component 4.3 are interconnected by a frame component 4.2, which is arranged above the creel module 3 and processing module 1. Between the processing module 2 and the creel module 3, a service aisle 5 is formed below the frame component 4.2.

In the frame component 4.2, the processing module 2 is arranged on the side facing the service aisle 5, and the takeup module 1 on the side opposite thereto. Along the takeup module 1, a doffing aisle 6 is provided. Associated to the doffing aisle 6 is a second takeup module 1 of a second texturing machine, which is arranged in mirror-inverted relationship with the first texturing machine. This makes it possible to transfer the packages of two machines to one doffing device and remove them through the doffing aisle.

In its longitudinal direction (in FIG. 2, the drawing plane corresponds to the transverse plane) the texturing machine comprises a plurality of processing stations, each for one yarn per processing station. The takeup units 18 occupy a width of three processing stations. Consequently, as will be described further below, three takeup units 18 are superposed in a column in the takeup module 1.

Each processing station comprises two creel yarn feed units 101 and 102, which are arranged on the creel module 3. The upper creel yarn feed unit 101 is stationarily connected with the creel module 3. The second creel yarn feed unit 102 is arranged on a pivotal support 44, which is mounted on a pivot axle 46. The pivot axle 46 is stationarily held on the creel module 3. An adjustable actuator 45 engages the support 44, and holds it in a predetermined yarn feed position.

A feed yarn package 8 and 35 in a creel 7 are associated to the creel yarn feed units 101 and 102 respectively. In the creel 7, the feed yarn packages 8 and 35 of adjacent processing stations are arranged in tiers, one above the other. Associated to each feed yarn package 8 is a reserve package 43. The feed yarn package 8 holds a synthetic flat yarn 36, and the feed yarn package 35 a synthetic yarn 37. The upper feed yarn withdrawal device 101 unwinds the yarn 36 via an overhead yarn guide 34 and a deflection roll 9. The lower creel yarn feed unit 102 unwinds the second yarn 37 from feed yarn package 35 likewise via an overhead yarn guide 34 and a deflection roll 9. Both yarns 36 and 37 advance together into a texturing zone. To this end, the creel yarn feed units 101 and 102 extend in one yarn advance plane.

In the following the further processing units of a processing station are described with reference to the path of the yarns 36 and 37. In the direction of the advancing yarns, downstream of the creel yarn feed units 101 and 102 an entanglement device 38 extends, which combines the yarns 36 and 37 to a composite yarn 39. Subsequently, the composite yarn 39 is deflected by a twist stop roll 10 and advanced through an elongate primary heater 11. The primary heater 11 could be constructed as a high-temperature heater, which has a heating surface temperature above 300° C.

In the direction of the advancing yarn, downstream of the primary heater 11, a cooling device 12 is provided. The primary heater 11 and the cooling device 12 are successively arranged in one plane and held by the frame component 4.2 above the service aisle 5. In the inlet region of the primary heater 11, a deflection roll 10 is arranged, so that the composite yarn 39 crosses the service aisle 5 along an inverted V-shaped path. To this end, it would however be also possible to arrange the primary heater 11 and the cooling device 12 in two planes that extend relative to each other in the shape of a roof.

On the side of the service aisle 5 opposite to the creel module 3, the processing module 2 is arranged on the frame component 4.3. The processing module 2 mounts in the direction of the advancing yarn and one below the other, a texturing unit 13, a draw unit 14, and a set yarn feed unit 15. In this arrangement, the composite yarn 39 advances from the outlet of the cooling device 12, which is preferably a cooling rail, to the texturing unit 13, which is constructed, for example, as a false twist unit. An electric motor 26 drives the false twist unit 13, which may be formed, for example, by a plurality of overlapping friction disks.

The draw unit 14 withdraws the composite yarn 39 from the texturing zone. To draw the composite yarn 39 in the texturing zone, the draw unit 14 and the creel yarn feed units 101 and 102 are driven at different speeds.

Downstream of the draw unit 14 is the set yarn feed unit 15, which advances the composite yarn 39 directly into a secondary heater 16. To this end, the secondary heater 16 is arranged on the underside of frame component 4.3 and thus below the processing module 2 and the takeup module 1. The secondary heater 16 forms the yarn passage from the processing module 2 to the takeup module 1. By integrating the processing module 2, the secondary heater 16, and the takeup module 1 into the frame component 4.3, a very short yarn path is realized, which is made substantially U-shaped. To this end, the underside of the takeup module 1, mounts a feed unit 17, which withdraws the composite yarn 39 directly from the secondary heater 16, and advances the composite yarn 39 after deflecting it, to the takeup unit 18. The set yarn feed unit 15 and the feed unit 17 are driven at such different speeds that they enable a shrinkage treatment of the composite yarn 39 inside the secondary heater 16. The secondary heater of this embodiment is a biphenyl-heated contact heater.

In the case that no heat treatment of the composite yarn is desired in the set zone, the secondary heater 16 is disconnected or replaced with a guide tube.

In the present embodiment, the takeup unit 18 is schematically illustrated by a yarn traversing device 20, a drive roll 19, and a package 21. In addition, the takeup unit 18 comprises a tube magazine 22 for performing an automatic package doff. The auxiliary devices needed for doffing the full packages are not shown in greater detail.

In their construction, the feed units 101, 102, 14, 15, and 17 are identical, so that they are described in the following by the example of creel yarn feed unit 101. Each feed unit is formed by a godet 23 and an associated guide roll 24. The godet 23 is operated by a drive 25. The godet drive 25 is preferably an electric motor. The guide roll 24 is supported for free rotation, with the yarn 36 advancing over the godet 23 and the guide 24 by looping them several times.

In the embodiment of the texturing machine shown in FIG. 2, the creel module 3 mounts two creel yarn feed units 101 and 102. In this arrangement, the yarn feed position of the adjustable creel yarn feed unit 102 is selected such that both yarns 36 and 37 after being withdrawn from the creel 7 jointly advance into the texturing zone. After being entangled by means of the entanglement device 38, the yarns 36, 37 are combined before being textured.

The yarn feed position of the second yarn 37 can also be selected by the creel yarn feed unit 102, for example, in such a manner that both yarns 36 and 37 are able to advance side by side in the texturing zone for being textured separately. However, the yarn feed position could also be adjusted by an actuator 45 such that the yarn 37 advances outside of the texturing zone.

To produce a novelty yarn, the creel module 3 may be optionally equipped with additional processing units, such as an additional feed unit and a draw pin for preliminarily drawing the yarn 37.

Figure 3:
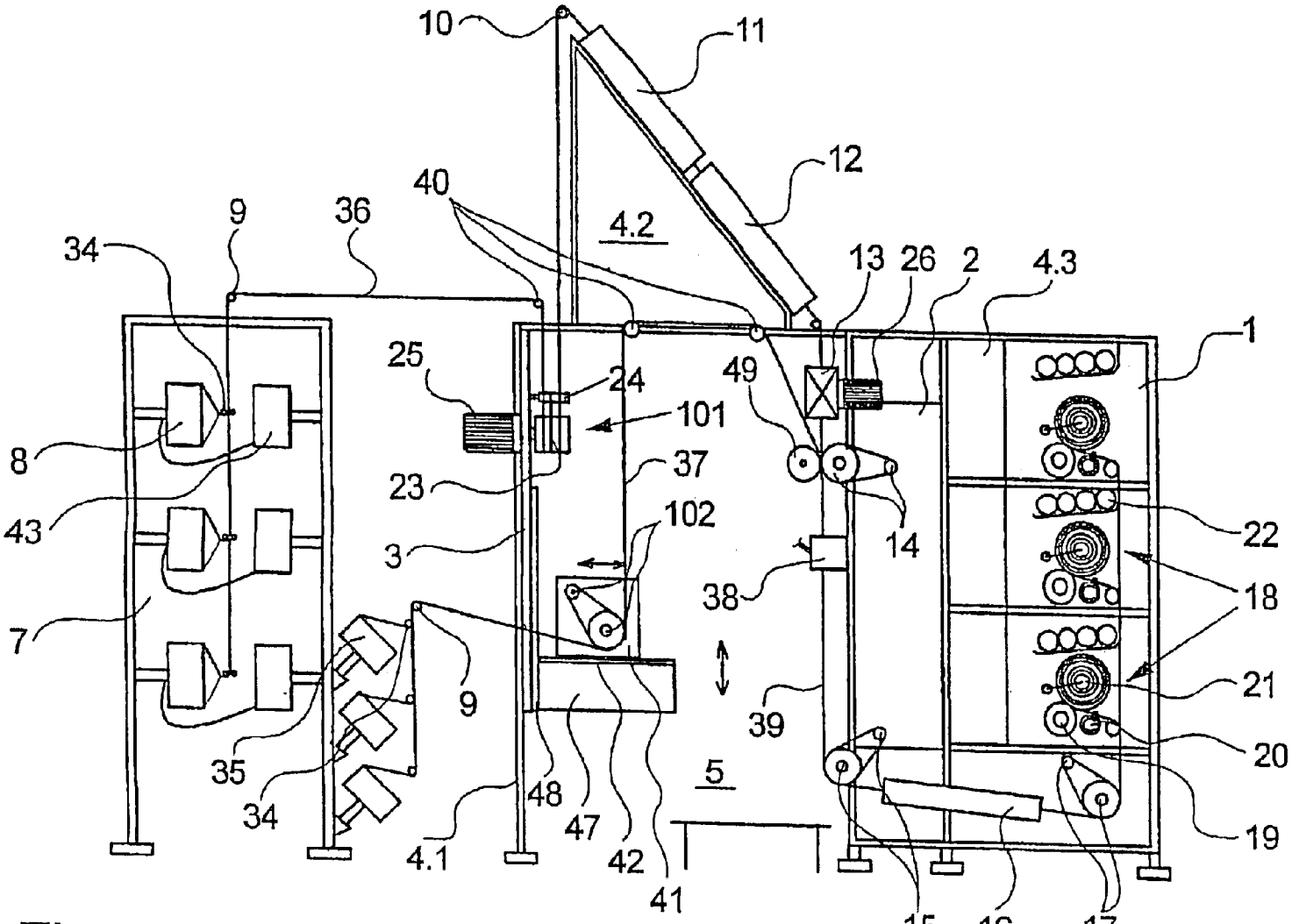
FIG. 3 is a schematic cross sectional view of a further embodiment of the texturing machine according to the invention.

FIG. 3 schematically illustrates a further embodiment of the texturing machine according to the invention. The embodiment is largely identical with the embodiment of the texturing machine of FIG. 2. To this extent, the foregoing description is herewith incorporated by reference and only differences are described in the following.

The creel yarn feed unit 102 is arranged on the movable support 41, which extends in horizontal guide rails 42. The guide rails 42 are arranged on a carriage 47. The creel module 3 mounts the carriage 47 for movement in a vertical carriage guideway 48. This permits adjusting the creel yarn feed unit 102 on the creel module 3 in the vertical direction by the carriage 47, and in the horizontal direction by the support 41.

In the position of the creel yarn feed unit 102 as shown in FIG. 3, a yarn feed position is selected, which advances the yarn 37 outside of the texturing zone directly to the draw unit 14. To this end, the draw unit 14 comprises an additional pressure roll 49, so that both yarns 36 and 37 are safely guided. Between the draw unit 14 and the set yarn feed unit 15, an entangling device 38 is arranged, which is used to combine the yarn 37 with the textured yarn 36 to the composite yarn 39.

The yarn path in the processing station is essentially identical with the embodiment of FIG. 2, so that at this point the foregoing description is herewith incorporated by reference.

Figure 4:
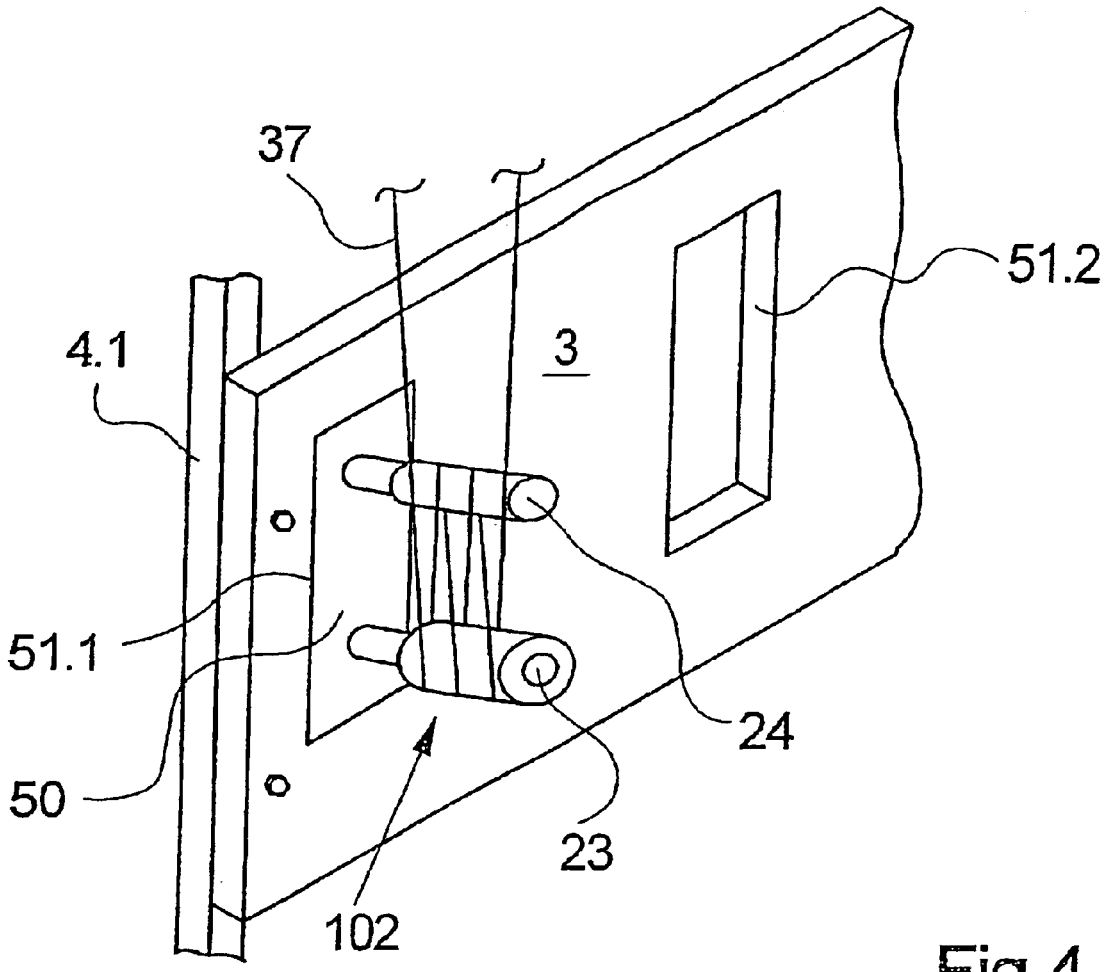
FIG. 4 is a schematic partial view of a still further embodiment of the texturing machine according to the invention.

FIG. 4 schematically illustrates a partial view of a further embodiment of the texturing machine according to the invention. The construction of the texturing machine could be identical with the foregoing embodiments. To this end, the foregoing embodiments are herewith incorporated by reference. FIG. 4 illustrates the adjustable creel yarn feed unit 102 of one of the processing stations that are arranged in parallel side-by-side relationship. The creel yarn feed unit 102 is formed by a godet 23 and a guide roll 24, with the godet 23 being driven by a drive in the form of an individual motor (not shown). The creel yarn feed unit 102 is mounted to an exchangeable support 50. To accommodate the exchangeable support 50, a creel module 3 is provided, which comprises a plurality of receptacles 51.1 and 51.2. FIG. 4 illustrates the situation, in which the exchangeable support 50 is held in receptacle 51.1. To secure the exchangeable support 50, it would be possible to provide one or more quick-action fasteners, which ensure the mount of the exchangeable support 50 in the receptacle 51.1. In the illustrated operating position, the creel yarn feed unit 102 advances a second yarn 37 into the processing station. In this process, the yarn feed position that is defined by receptacle 51.1 could be used to advance the yarn 37 with a second yarn 36 through a false twist texturing zone, as shown, for example, in FIG. 2.

In the case that a different type of composite yarn is to be produced with the texturing machine of the invention, in which only one of the separate yarns forming the composite yarn undergoes texturing, the creel yarn feed unit 102 is adjusted. To this end, the exchangeable support 50 is removed from receptacle 51.1. Thereafter, the exchangeable support 50 with the creel yarn feed unit 102 is inserted into the receptacle 51.2 and secured therein. Preferably, the creel yarn feed unit 102 is energized via releasable plug connectors. It is now possible to produce a composite yarn, with the individual yarn 37 advancing outside of the texturing zone.

The embodiments of the texturing machine shown in FIGS. 2 and 3 are exemplary in the configuration and setup of the processing units. Basically, there exists the possibility of operating the feed units each individually or in groups. In this connection, it is also possible to use conventional nip feed units in the place of the godets.

That which is claimed:

1. A yarn processing machine for processing a plurality of synthetic yarns to form a composite yarn, comprising a machine frame, a plurality of processing units mounted on said frame, said processing units including a yarn takeup unit for winding a yarn into a package, and at least two yarn feed units for withdrawing respectively one yarn from a feed package and feeding the withdrawn yarn from a feed position defined by the yarn feed unit along a path of travel to said yarn takeup unit, wherein at least one of the yarn feed units is mounted for selective movement on the frame in such a manner that different yarn feed positions are selectable by adjusting the position of the moveable yarn feed unit on the machine frame.

2. The yarn processing machine of claim 1 wherein the moveable yarn feed unit is mounted to a support which in turn is mounted for movement along at least one guide rail which is fixed to the frame.

3. The yarn processing machine of claim 1 wherein the moveable yarn feed unit is mounted to a support which in turn is mounted for movement along at least one guide rail, wherein the at least one guide rail is mounted to a carriage which is supported by a carriage guideway which is mounted to the machine frame and so that the carriage is moveable in the direction of the guideway.

4. The yarn processing machine of claim 3 wherein the direction of movement of the support along the at least one guide rail is substantially horizontal and the direction of movement of the carriage along the guideway is substantially vertical.

5. The yarn processing machine of claim 1 wherein the moveable yarn feed unit is mounted to a support which is mounted for pivotal movement on the machine frame.

6. The yarn processing machine of claim 1 wherein the moveable yarn feed unit is mounted to a support which is removeably mounted in one of several receptacles on the machine frame.

7. The yarn processing machine of claim 1 wherein the moveable yarn feed unit is rotatably driven by a controllable individual drive.

8. The yarn processing machine of claim 1 wherein the machine frame includes a creel module which supports the yarn feed units, and a processing module which faces the creel module so as to define a service aisle therebetween, with the processing module mounting at least a portion of the processing units so that the yarn feed units on the creel module and the processing units on the processing module can be accessed from the service aisle.

9. The yarn processing machine of claim 8 wherein the processing units include a heater and a cooling device which are arranged above the service aisle in the configuration of an inverted V so that at least one of the yarns can advance through the heater and the cooling device.

10. The yarn processing machine of claim 1 wherein each of the yarn feed units comprises a godet and an associated guide roll whereby the advancing yarn can loop several times about the godet and guide roll, and wherein the godet is driven independently of other yarn processing units.

11. The yarn processing machine of claim 1 wherein the processing units further include a yarn entanglement device positioned along the path of travel for joining the yarns being fed from each of the at least two yarn feed units.

12. A yarn false twist texturing apparatus comprising a machine frame, a plurality of yarn processing units including a yarn heater, a cooling device, a false twist texturing device, and a yarn takeup device mounted to the frame so that a yarn may be serially advanced along a first path of travel through the units in the given order, said yarn processing units further including at least two yarn feed units for withdrawing respectively one yarn from a feed package and feeding the withdrawn yarn from a feed position defined by the yarn feed unit along said first path of travel to said yarn takeup unit, wherein at least one of the yarn feed units is mounted for selective movement on the frame in such a manner that different yarn feed positions are selectable by adjusting the position of the moveable yarn feed unit on the machine frame and whereby the associated yarn may be advanced along an alternative path of travel which bypasses at least some of the yarn processing units.

13. The yarn false twist texturing apparatus of claim 12 further comprising yarn guide means for guiding a yarn along said alternative path of travel and such that a yarn advancing along said first path of travel and a yarn advancing along said alternative path of travel may be joined at a location downstream of said false twisting unit to form a composite yarn.

14. The yarn false twist texturing apparatus of claim 13 further comprising a yarn entanglement device positioned downstream of the location at which the yarns are joined.

* * * * *